United States Patent [19]

Beacon

[11] 4,312,428

[45] Jan. 26, 1982

[54] TRUCK MOUNTED BRAKE APPARATUS

[75] Inventor: Robert G. Beacon, Sparta, N.J.

[73] Assignee: Ellcon-National, Inc., Totowa, N.J.

[21] Appl. No.: 120,008

[22] Filed: Feb. 8, 1980

[51] Int. Cl.[3] ..... B61H 13/26

[52] U.S. Cl. ..... 188/52; 188/198; 188/210; 188/219.1

[58] Field of Search ..... 188/52, 197, 198, 207–210, 188/219.1

[56] References Cited

U.S. PATENT DOCUMENTS

| | | | |
|---|---|---|---|
| 1,630,046 | 12/1915 | Thompson | 188/210 |
| 2,389,644 | 11/1945 | Douglass et al. | 188/207 |
| 2,958,398 | 11/1960 | Newell | 188/52 |
| 3,335,825 | 8/1967 | Nermersireau et al. | 188/95 |
| 3,406,794 | 10/1968 | Nersereau | 188/195 |
| 3,680,667 | 8/1972 | Ludington et al. | 188/198 |
| 3,850,269 | 11/1974 | Deacon | 188/202 |
| 3,889,783 | 6/1975 | Sittner et al. | 188/52 |
| 4,128,148 | 12/1978 | Schmitt | 188/197 |

*Primary Examiner*—David L. Lacey

*Attorney, Agent, or Firm*—Brooks, Haidt, Haffner & Delahunty

[57] ABSTRACT

Truck mounted brake apparatus comprising a saddle which clamps onto the bolster of a railway car truck and which carries a fluid actuable, piston and cylinder assembly at one side of the bolster. A first lever connected at one end to the piston rod and at the opposite end to a standard brake beam is also connected intermediate its ends to one end of an automatic slack adjuster which passes through the bolster. A second lever is connected at one end to the saddle at the side thereof opposite to the side on which the piston and cylinder assembly is mounted, is connected at its opposite end to another standard brake beam and is connected intermediate its ends to the opposite end of the slack adjuster. The first lever has an extension to which a hand brake may be connected.

8 Claims, 4 Drawing Figures

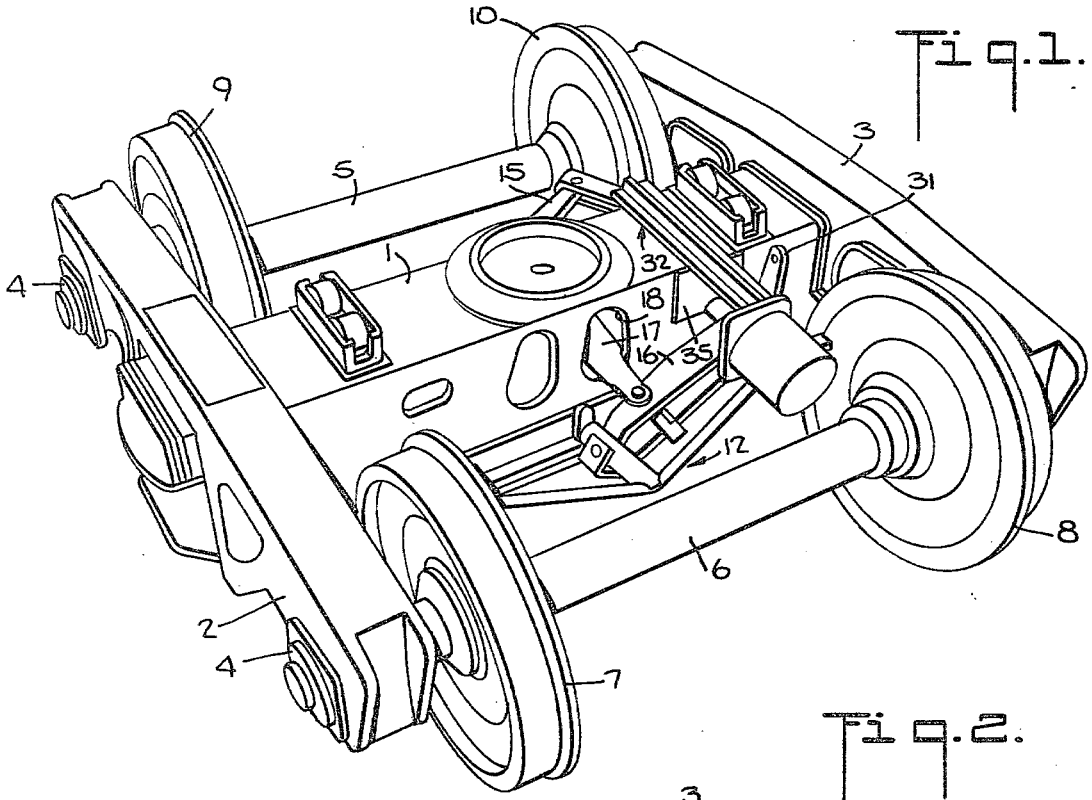
Fig. 1.
Fig. 2.
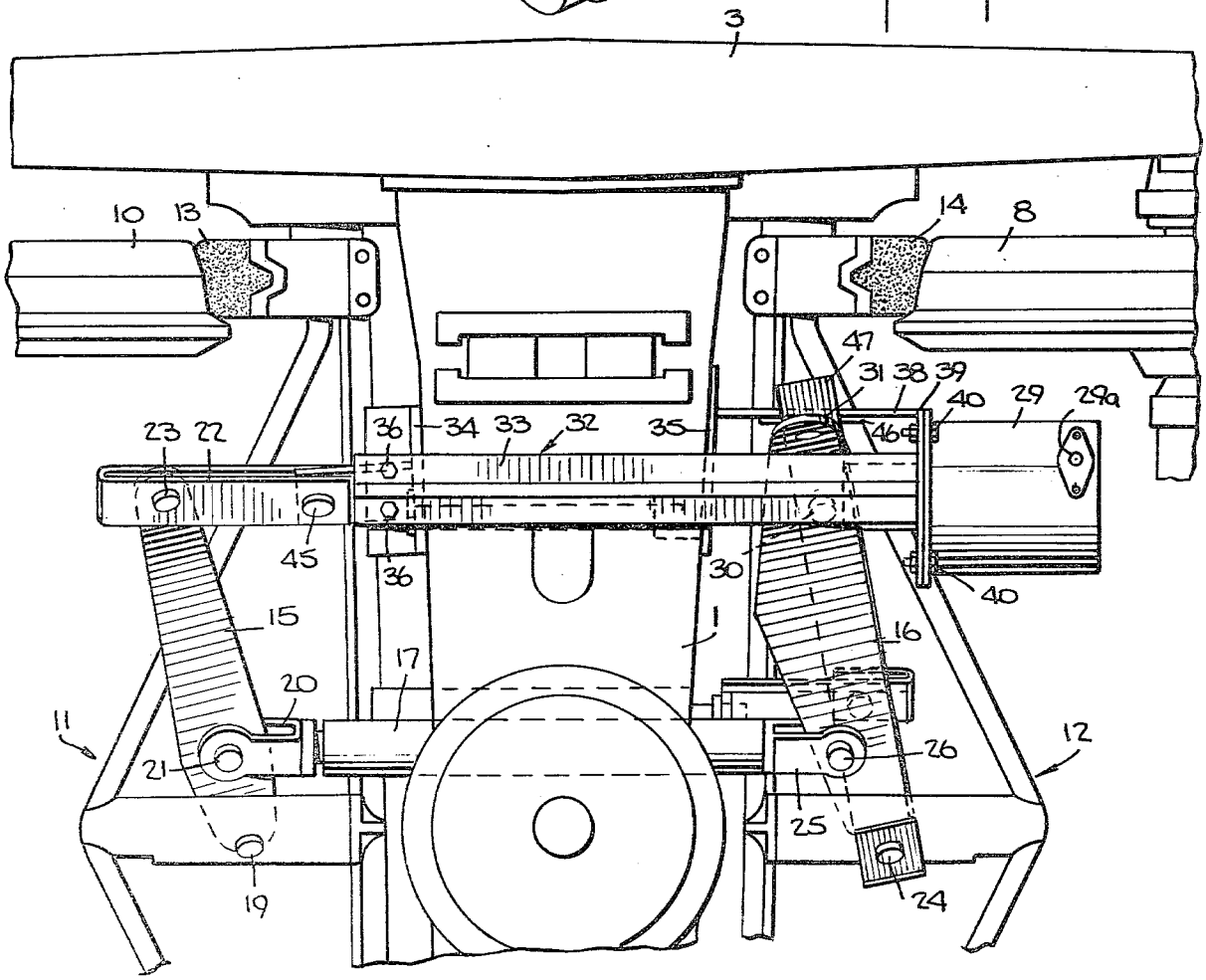

TRUCK MOUNTED BRAKE APPARATUS

This invention relates to truck mounted brake mechanisms for railway cars and particularly, to brake mechanisms of the type in which the fluid operated cylinder for the brakes of a car is also mounted on the truck.

Most railroad freight cars use what is known as a foundation brake rigging. On the car body, there is an air brake system which, ultimately, provides air to the brake cylinder. The brake cylinder, in turn, supplies a mechanical force, through a system of rods and levers to a connection on the standard freight car trucks located at each end of the car. At this point, the force is applied to a truck lever system usually consisting of two levers and a connecting rod. The levers move brake beams which apply force to the treads of the wheels through renewable friction blocks or brake shoes, retarding the rotation of the wheels.

Most freight cars have two four-wheel trucks of a basic three-piece design, consisting of one bolster, having a central pivot on which the car body rests, and two side frames which support the bolster as well as the brake beams and the bearings in which the wheel and axle sets turn. The bolster usually rests on a nest of springs located in each side frame.

This foundation brake rigging that runs from the brake cylinder to each end of the car is cumbersome, costly and inefficient because of many friction points. In some cases, the car structure presents obstacles to a practical installation of this foundation brake rigging.

It has been proposed in the prior art to overcome the problems of foundation riggings by providing one or more brake cylinders on each truck which are connected to brake beams on the truck. One type of proposal is set forth in U.S. Pat. No. 2,958,398, and while the system disclosed therein has been used commercially, two brake cylinders per truck as part of special brake beams are required, and substantial mounting requirements are involved. Another proposal, set forth in U.S. Pat. No. 3,386,533, uses standard brake beams but requires a special bolster with a push rod extending therethrough and a brake cylinder bolted to the bolster. A similar proposal is set forth in U.S. Pat. No. 3,406,794. Various other arrangements are described in U.S. Pat. Nos. 2,815,092; 3,107,754; 3,266,601; 3,286,798; 3,298,475; 3,335,825 and 3,442,358. In general, the prior art truck mounted braking mechanisms require one or more of the following:

(1) special, modified bolsters (2) modified brake beams (3) a pair of brake cylinders (4) a substantial number of levers which increases friction and slack (5) space not available with some car constructions.

It is one object of the invention to overcome the problems of prior art foundation riggings by providing a truck mounted brake mechanism which does not have the drawbacks of prior art truck mounted brake mechanisms.

In accordance with the preferred embodiment of the invention, a saddle, which is clamped on the bolster of a truck, supports the brake cylinder and a first lever which connects the piston rod of the cylinder to a first standard brake beam for braking one pair of the truck wheels. The saddle also supports a second lever at the side of the bolster opposite from the side at which the cylinder is mounted, and such lever also connects to a second standard brake beam for braking the other pair of truck wheels. An automatic slack adjuster which passes through an opening in the bolster interconnects the first and second levers, and the actuating lever therefor extends from the point of connection of the first lever to the first brake beam to adjacent the saddle. An arm for the connection of a hand brake linkage extends from the first lever adjacent the piston rod.

Other objects and advantages of the present invention will be apparent from the following detailed description of the presently preferred embodiments thereof, which description should be considered in conjunction with the accompanying drawings in which:

FIG. 1 is a perspective view of a railway car truck with the braking apparatus of the invention thereon;

FIG. 2 is an enlarged, fragmentary, plan view of the embodiment shown in FIG. 1;

Figure 4:
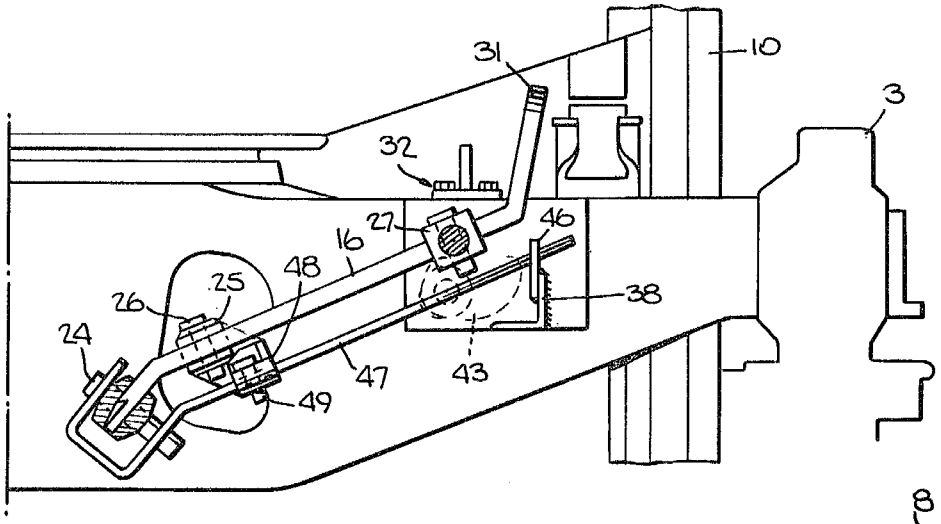
FIG. 4 is an end elevation view of a portion of the apparatus shown in the preceding figures.

FIG. 1 illustrates a typical railway car truck comprising a bolster 1 supported by a pair of side frames 2 and 3 which carry bearings 4 which receive the axles 5 and 6 of the wheels 7–10 which ride on the railway rails. The railway car is supported at one end by the bolster 1, and a similar truck supports the opposite end of the car.

As best seen in FIG. 2, a pair of conventional brake beams 11 and 12 carry brake shoes at their opposite ends, the shoe 13 at one end of the beam 11 and the shoe 14 at one end of the beam 12 being shown in FIG. 2 and corresponding shoes (not shown) being located at the opposite ends of the beams 11 and 12. When the brakes are actuated, the beams 11 and 12 press the brake shoes against the peripheries of the wheels 7–10 to brake the car.

Figure 3:
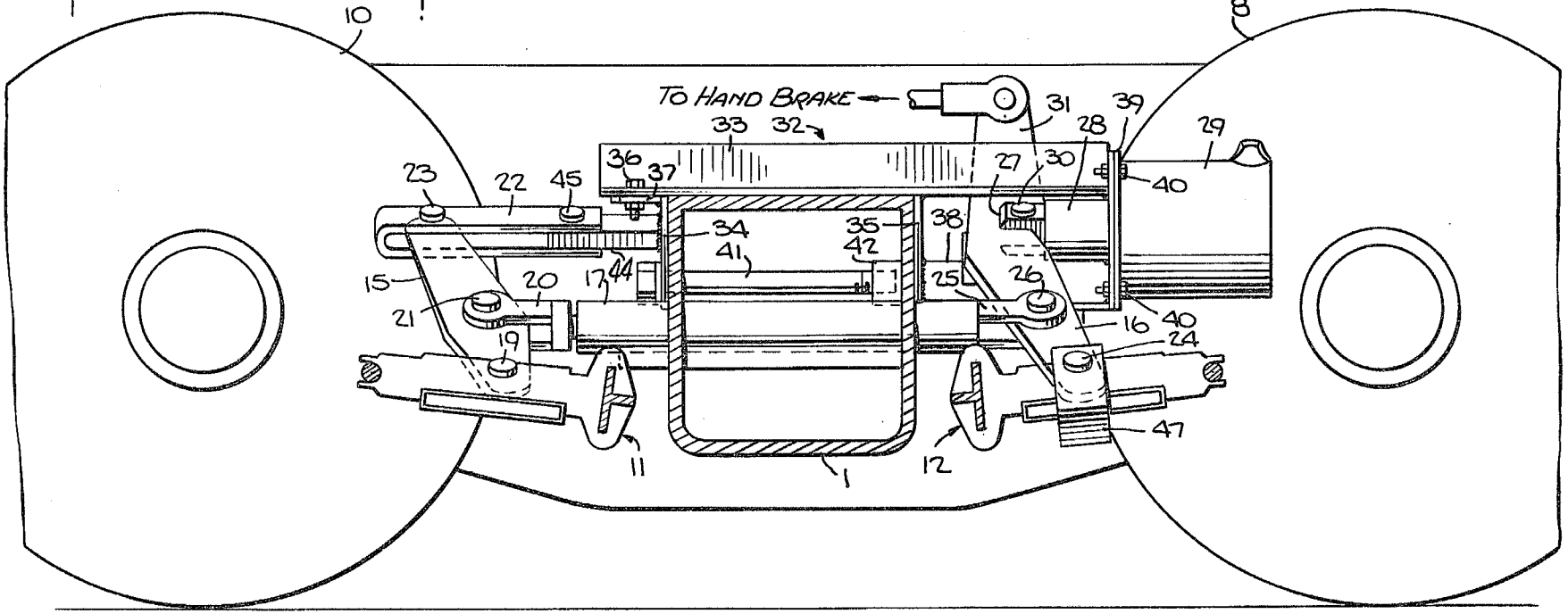
FIG. 3 is an enlarged, side elevation view, partly in section, of the embodiment shown in FIG. 1.

The beams 11 and 12 are movable by levers 15 and 16 respectively, and the levers 15 and 16 are interconnected by brake force transmitting means in the form of a floating, double acting, slack adjuster 17 of a known type which passes through openings, such as the opening 18, normally found in the bolsters in use. The lever 15 is pivotally connected at one end to the beam 11 by a pin 19, is pivotally connected intermediate its ends to the yoke 20 of the slack adjuster 17 by a pin 21 and is pivotally connected at its opposite end to a dead lever fulcrum or link 22 by a pin 23. The lever 16 is pivotally connected at one end to the beam 12 by a pin 24, is pivotally connected intermediate its ends to the yoke 25 of the slack adjuster 17 by a pin 26 and is pivotally connected at its opposite end by a pin 30 to the yoke 27 (see FIG. 3) of a piston rod 28 extending from a cylinder 29. The lever 16 has an extension 31 to which the hand brake operated member, such as a chain or rod of a hand brake mechanism, may be connected for setting the brakes by hand.

The cylinder 29 and the fulcrum 22 are supported from the bolster 1 by a saddle 32 which mounts on the bolster 1. The saddle 32 comprises a member 33 which is T-shaped in cross-section and which engages the top of the bolster 1. The member 33 is secured to a pair of side members in the form of plates 34 and 35, and the plates 34 and 35 engage opposite sides of the bolster 1. The plate 35 may be secured to the member 33 by welding, and the member 33 may be secured by bolts 36 to a plate 37 which is secured to the plate 34, such as by welding. The saddle 32 also comprises an angle member 38 secured at one end, such as by welding, to the place 35, and secured at its opposite end, such as by welding, to a further plate 39 to which the cylinder 29 is secured by bolts 40. The plate 39 is also secured to the end of the member 33, such as by welding.

The saddle 32 is clamped on the bolster 1 by a bolt 41 (see FIG. 3) which extends through a hole normally found in the bolsters in use and which engages a threaded sleeve 42 secured to the plate 35, such as by welding. The sleeve 42 extends through a hole, such as the hole 43 (see FIG. 4) normally found in the bolsters in use. Thus, after the saddle 32 is mounted on the bolster 1, the bolt 41 is inserted through a hole in the plate 34 and a hole in the bolster 1 and into engagement with the sleeve 42, the threads on the end of the bolt 41 engaging the internal threads of the sleeve 42, and the bolt 41 is tightened thereby pulling the plates 34 and 35 against the sides of the bolster 1.

The saddle 32 also comprises a bracket 44 secured to the face of the plate 34, such as by welding, to which the fulcrum 22 is pivotally connected by a pin 45. In addition the saddle 32 comprises a plate 46 (see FIG. 4) secured to the angle member 38, such as by welding, the plate 46 having a slot therein for receiving the slack adjuster actuating lever 47 described hereinafter.

As previously mentioned, the slack adjuster 17 may be of a known type and may, for example, be a slack adjuster of the type described and illustrated in U.S. Pat. No. 3,406,794 or 3,850,269. The trigger or actuator of the slack adjuster 17 is connected to a member 48 which is pivotally connected to the actuating lever 47 by a pin 49 (see FIG. 4). The actuating lever 47 is pivotally connected at one end to the beam 12 and to one end of the lever 16 by the pin 24, and movement of the opposite end of the lever 47 is limited by the end walls of the slot in the plate 46 which act as stop means. Accordingly, the slack adjuster 17 is actuated by the lever 47 and operates as described in said patents to take up excess slack or to compensate for the replacement of worn brake shoes by new brake shoes.

The braking apparatus of the invention is easily installed on a large number of the car trucks now in use by merely mounting the saddle 32 on the bolster 1 and connecting the various brake parts to the saddle 32 and to each other in the manner described hereinbefore. It will be observed that only one cylinder 29 is required for each truck and that, upon the application of the brakes by admitting fluid under pressure into the cylinder 29, the rod 28 moves toward the bolster 1 but does not pass therethrough. Furthermore, modification of the bolster 1 is not required. Also, the apparatus of the invention uses only two levers, levers 15 and 16, per truck, and standard brake beams 11 and 12 are used. The lever ratios can be readily changed, and the required hand brake force can be obtained by the correct lever ratio and without the need for high powered, higher priced hand brake mechanisms.

In operation, the brake shoes are pressed against the wheels 7–10 by admitting fluid, such as air, under pressure to the cylinder 29 by way of the fitting 29*a* (see FIG. 2). Such fluid causes the piston rod 28 to move to the left, as viewed in FIG. 3, which causes the end of the lever 16 attached to the yoke 27 on the rod 28 to move to the left. Such movement of the end of the lever 16 also causes the slack adjuster 17 to move to the left while, at the same time the opposite end of the lever 16 causes the beam 12 to move to the right. Movement of the slack adjuster 17 to the left causes the end of the lever 15 connected to the beam 11 to move to the left which moves the beam 11 to the left. Thus, the beams 11 and 12 move in directions which cause the brake shoes thereon to engage the wheels 7–10. When the fluid is exhausted from the cylinder 29, the beams 11 and 12 are moved away from the wheels 7–10 in an obvious manner. During movements of the levers 15 and 16, excess or too little slack in the rigging is compensated for by the adjuster 17, the actuator of which is actuated by the actuating lever 47.

Although preferred embodiments of the present invention have been described and illustrated, it will be apparent to those skilled in the art that various modifications may be made without departing from the principles of the invention.

What is claimed is:

1. Brake apparatus for a truck having a bolster supported by wheels and having a pair of brake shoe means for engaging said wheels, said apparatus comprising:

a saddle having a top member and a pair of spaced side members for engaging said bolster, and having mounting means for mounting a fluid actuable, piston and cylinder assembly at one side of one of said side members in spaced relation to said one side member;

clamping means for securing said saddle to said bolster;

a fluid actuable piston and cylinder assembly mounted on said mounting means, the piston having a rod extending from said cylinder toward said one side member;

a first lever;

means for pivotally connecting a first portion of said first lever to said piston rod;

means for connecting a second portion of said lever spaced from said first portion thereof to one of said brake shoe means;

a second lever;

fulcrum means for pivotally connecting said second lever at one end to said saddle at the side thereof opposite to the side thereof at which said piston and cylinder assembly is mounted;

means for connecting the opposite end of said second lever to the other of said brake shoe means;

and brake force transmitting means for interconnecting a portion of said first lever intermediate the first and second portions thereof to an intermediate portion of said second lever, whereby movement of said piston rod in the brake applying direction causes movement of said first lever, said second lever and said brake shoe means in directions which will cause portions of said brake shoe means to engage said wheels.

2. Brake apparatus as set forth in claim 1 wherein said first lever has a portion thereof extending from the point of connection thereof with said piston rod in a direction away from the point of connection of said first lever with said brake force transmitting means for receiving a hand brake operated member.

3. Brake apparatus as set forth in claim 1 wherein said brake force transmitting means comprises an automatic slack adjuster having an actuator and with one end thereof connected to said second lever, an actuating lever for actuating said actuator, and means for connecting a portion of said actuating lever to said first lever for movement therewith and with an end of said actuating lever spaced from said portion thereof disposed adjacent said saddle, said saddle further comprising stop means engageable with said end of said actuating lever for limiting movement thereof and thereby actuating said actuator.

4. Brake apparatus as set forth in claim 1 or 3 wherein said side members are plates secured to said top member and extending substantially perpendicularly thereto and in the same direction therefrom, said one side member being secured to said top member at a portion thereof spaced from an end of said top member, wherein said mounting means comprises a plate secured to and extending from said end of said top member and a further member interconnecting and secured to said last-mentioned plate and to said one side member, wherein said clamping means comprises a bolt and a threaded member for receiving said bolt, said bolt engaging said other side member and said threaded member engaging said one member for urging said side members toward each other and wherein said fulcrum means comprises a link pivotally mounted from said other side member and pivotally connected to said one end of said second lever.

5. In combination with a truck having a first axle with a pair of wheels at opposite ends thereof and spaced from and parallel to said first axle, a pair of frames supported by said axles, one frame extending between one end of one axle and one end of the other axle and the other frame extending between the other end of said one axle and the other end of the other axle, a bolster extending in its length direction from one frame to the other frame and disposed intermediate said axles, said bolster having openings therein and extending therethrough in the direction from said one axle to said other axle, a first brake beam between said bolster and said first axle and having brake shoes engageable with the wheels on said first axle, and a second brake beam between said bolster and said second axle and have brake shoes engageable with the wheels on said second axle, brake apparatus comprising:

a saddle comprising a top member extending across and engaging the top of said bolster, a pair of side members, one engaging one side of said bolster and the other engaging the other side of said bolster, and mounting means for mounting a fluid actuable, piston and cylinder assembly at one side of said bolster and in spaced relation to said bolster;

clamping means extending from one of said side members to the other of said side members and through one of said openings in said bolster for urging the side members toward each other;

a fluid actuable, piston and cylinder assembly mounted on said mounting means, said piston having a rod extending from said cylinder and toward said bolster;

a first lever having a first portion pivotally connected to said rod, a second portion spaced from said first portion and pivotally connected to the brake beam at the same side of said bolster as said piston and cylinder assembly;

a second lever having an end portion pivotally connected to said saddle at the side of said bolster opposite to the side of said bolster at which said first lever is disposed and pivotally connected at the opposite end portion thereof to the brake beam at the same side of said bolster as said second lever; and brake force transmitting means pivotally interconnecting a portion of said first lever intermediate the first and second portions thereof and a portion of said second lever intermediate the end portions thereof, said force transmitting means extending through one of said openings in said bolster.

6. The combination as set forth in claim 5 wherein said brake force transmitting means comprises an automatic slack adjuster having an actuator and with one end thereof connected to said first lever and the other end thereof connected to said second lever, an actuating lever for actuating said actuator, and means for connecting said actuating lever to said first lever for movement therewith and with an end of said actuating lever adjacent said saddle, said saddle further comprising stop means engageable with said end of said actuating lever for limiting movement thereof and thereby actuating said actuator.

7. The combination as set forth in claim 5 or 6 wherein said side members are plates secured to said top member and extending substantially perpendicularly thereto and in the same direction therefrom, said one side member being secured to said top member at a portion thereof spaced from an end of said top member, wherein said mounting means comprises a plate secured to and extending from said end of said top member and a further member interconnecting and secured to said last-mentioned plate and to said one side member, wherein said clamping means comprises a bolt and a threaded member for receiving said bolt, said bolt engaging said other side member and said threaded member engaging said one member for urging said side members toward each other and wherein said fulcrum comprises a link pivotally mounted from said other side member and pivotally connected to said one end of said second lever.

8. The combination as set forth in claim 5 or 6 wherein said first lever has a portion thereof extending from the point of connection thereof with said piston rod in a direction away from the point of connection of said first lever with said brake force transmitting means for receiving a hand brake operated member.

* * * * *

UNITED STATES PATENT AND TRADEMARK OFFICE

CERTIFICATE OF CORRECTION

PATENT NO. : 4,312,428

DATED : January 26, 1982

INVENTOR(S) : Robert G. Beacon

It is certified that error appears in the above-identified patent and that said Letters Patent are hereby corrected as shown below:

Column 5, line 22, after "thereof" insert -- , a second axle with a pair of wheels at opposite ends thereof--.

Signed and Sealed this

*Fourth* Day of *May 1982*

[SEAL]

*Attest:*

GERALD J. MOSSINGHOFF

*Attesting Officer*

*Commissioner of Patents and Trademarks*